US006159585A

United States Patent [19]

Rittenhouse

[11] Patent Number: 6,159,585

[45] Date of Patent: Dec. 12, 2000

[54] SECURITY PAPER

[75] Inventor: David A. Rittenhouse, Roswell, Ga.

[73] Assignee: Georgia-Pacific Corporation, Atlanta, Ga.

[21] Appl. No.: 09/401,664

[22] Filed: Sep. 23, 1999

Related U.S. Application Data

[63] Continuation-in-part of application No. 08/819,565, Mar. 14, 1997, abandoned.

[51] Int. Cl.[7] ..... B32B 3/00; B32B 5/16; B32B 29/00

[52] U.S. Cl. ..... 428/199; 428/207; 428/537.5; 428/916; 162/140

[58] Field of Search ..... 428/199, 207, 428/328, 330, 402.2, 402.24, 537.5, 913, 915, 916; 162/140, 158, 162, 181.2; 283/72

[56] References Cited

U.S. PATENT DOCUMENTS

| | | | |
|---|---|---|---|
| 223,136 | 12/1879 | Hendrichs | 428/199 |
| 1,172,414 | 2/1916 | Weis | 428/199 |
| 1,217,076 | 2/1917 | Schmidt | 428/199 |
| 1,589,210 | 6/1926 | Murray | 428/199 |
| 2,780,015 | 2/1957 | Whitehead | 40/2.2 |
| 3,481,759 | 12/1969 | Ostlie | 117/36.2 |
| 3,516,846 | 6/1970 | Matson | 117/36.2 |
| 3,562,098 | 2/1971 | Plumez et al. | 162/134 |
| 3,886,083 | 5/1975 | Laxer | 252/301.2 R |
| 4,037,007 | 7/1977 | Wood | 428/199 |
| 4,414,259 | 11/1983 | Tsuchiya et al. | 428/207 |
| 4,496,961 | 1/1985 | Devrient | 346/206 |
| 4,618,402 | 10/1986 | Camus | 162/140 |
| 4,761,205 | 8/1988 | Crane | 162/103 |
| 4,846,502 | 7/1989 | Chang et al. | 283/57 |
| 4,957,778 | 9/1990 | Yrjala | 427/152 |
| 5,058,925 | 10/1991 | Dotson | 283/95 |
| 5,123,999 | 6/1992 | Honnorat et al. | 162/140 |
| 5,156,717 | 10/1992 | Honnorat et al. | 162/140 |
| 5,209,515 | 5/1993 | Dotson et al. | 283/95 |
| 5,221,289 | 6/1993 | Miyamatsu et al. | 8/646 |
| 5,457,486 | 10/1995 | Malhotra et al. | 347/105 |

FOREIGN PATENT DOCUMENTS

| | | |
|---|---|---|
| 0 243 285 | 8/1989 | European Pat. Off. . |
| 0 632 162 A1 | 4/1995 | European Pat. Off. . |
| 0 440 554 A1 | 8/1998 | European Pat. Off. . |
| 635442 C | 9/1936 | Germany . |

OTHER PUBLICATIONS

International Search Report date Jun. 15, 1998.

Generalized Rosin Soap with Coordinating Elements, Rozin Sizing, Tappi Journal, vol. 75, No. 3, Mar. 1992.

Rosin Soap Sizing with Ferric Ions as Mordants, Rosin Sizing, Tappi Journal, vol. 76, No. 12, Dec. 1993, Jinfeng Zhuang and Christopher J. Biermann.

*Primary Examiner*—Paul Thibodeau
*Assistant Examiner*—Holly C Rickman
*Attorney, Agent, or Firm*—Banner & Witcoff, Ltd.

[57] ABSTRACT

A security paper indicates exposure to a solvent by a solvent resistant color signal. A metal mordant dye first co-reactant and a mordant dye second co-reactant form an organic solvent-insoluble colored reaction product when the paper is washed with an organic solvent. The metal mordant dye first co-reactant and a mordant dye second co-reactant are chemically isolated from each other so as to prevent the coordinate covalent bond from forming until the paper is washed with an organic solvent. The chemical isolation can be effected by encapsulation or other physical separation of the co-reactants. The organic solvent-insoluble colored reaction product, once formed, remains entrapped in the web when the paper is washed with an organic solvent. The chemical isolation prevents the organic solvent-insoluble colored reaction product from forming upon the application of pressure alone to the paper.

19 Claims, No Drawings

SECURITY PAPER

CROSS REFERENCE TO RELATED APPLICATION

This application is a continuation-in-part of application Ser. No. 08/819,565, filed Mar. 14, 1997 now abandoned.

FIELD OF THE INVENTION

The present invention is directed to a security paper which indicates its exposure to a solvent by developing an indelible color signal.

DESCRIPTION OF RELATED ART

Check fraud of all types has been estimated to cost between 2 to 10 billion dollars annually (Financial Stationers Association 1992 Annual Meeting). The loss due to check alteration and fraudulent copying is estimated at 40% to 50% of this amount (Fred Huffman, Vice President of Security-Bank South). The balance is comprised of fraud such as forgeries, writing checks on closed accounts, etc. Fraud of all types is estimated to cost the banking industry $10 per year per checking account (FSA 1992 Annual Meeting).

Retail establishments also lose money due to check fraud. Most fraud in this area is simple forgery or writing checks on a closed account. Many establishments have responded by refusing to accept checks. In spite of the additional 2% to 5% fee, many retail stores (e.g., Red Lobster, U-Haul) have required payment in cash, by credit card or by debit card and have refused to honor checks.

Simple forgery is perpetrated by several means including: 1) a person known by the victim steals unused checks; 2) a criminal opens an account with a bank using fictitious information and quickly passes many checks (generally on a weekend) before authorities determine that the checks are bad; and 3) a criminal orders checks from one of several mail order check printers and again supplies fraudulent information.

While these types of fraud cannot be stopped by improving the security of the paper used to prepare the checks, there are several alternate, more sophisticated, methods used to perpetrate check fraud that cost the industry millions of dollars. For example previously-used checks are altered either by chemically removing the ink with solvents, bleaches and the like, or by mechanically removing the image. Then, the altered check or a copy of the altered check is reissued and fraudulently cashed. For instance, in one approach a criminal can reproduce an apparent valid check from the altered check on a color laser printer. Due to the increased sophistication of these techniques, larger sums of money are stolen through these means. Use of a security paper for preparing the checks can be employed to combat one or more of these sophisticated kinds of check fraud.

One form of security paper currently available contains one or a combination of chemicals that indicate whether an attempt has been made to alter the check. One way to impart this feature to the paper is by adding a very fine particle size pigment to the wet end of a paper machine during paper formation. The pigment is insoluble in water and soluble in organic solvents such as acetone. When an attempt is made to alter a portion of such a check, the pigment dissolves in the solvent and forms a "starburst" or "water drop" appearance. Depending on the relative solubility and size of the pigment particle, the migratory boundary may be very distinct (small particles, high solubility), or the stain will be streaked (large particles, low solubility). Unfortunately, this color signal feature can be defeated by soaking the entire check in the solvent for a sufficient period of time. This processing uniformly dissolves the pigment from the paper.

Another way used to create a latent color signal in paper used for making checks is by adding the salt of acetic acid and 1,3-diphenylguanidine to the starch solution at the size press during paper formation. When this paper is exposed to an oxidizing agent, such as a bleach, it is "stained" a dark color. A problem with bleach indicators of this type is that they, too, are soluble in organic solvents. Therefore, when a criminal "washes" the ink from a used check using an organic solvent, the stain also washes out.

One technique used to form a colored image, often associated with facilitating the preparation of duplicate copies, involves providing a liquid (solvent soluble) dye co-reactant and a metal cation co-reactant during paper formation. The liquid dye co-reactant is encapsulated in a material to isolate it from the metal cation co-reactant. Attempts to alter the document with a writing instrument, or an eraser felt, can cause the capsules to rupture and the colored image to form by the reaction between the co-reactants. Other materials also may be provided to hinder formation of the colored image during routine handling of the document. This technique suffers from drawbacks as a way of preventing check fraud, including premature formation of the colored image upon the application of pressure to the document.

There remains a need for an improved security paper which effectively resists alteration by a solvent wash. In particular, there exists a need in the art for a security paper containing an indicia which becomes permanently colored upon exposure to a solvent, and which can not be dissolved out of the paper.

SUMMARY OF INVENTION

It is an object of the invention to provide a security paper which forms an indelible color when it is treated with an organic solvent.

It is another object of the invention to provide a method of making a security paper that is compatible with commercial paper making techniques.

It is yet another object of the invention to form an indelible color on a security paper when treated with an organic solvent, without requiring that the color-forming co-reactants be disposed in register with one another.

These and other objects of the invention are provided by one or more of the embodiments described below.

In accordance with one aspect of the invention there is provided a security paper which forms an indelible color when subjected to an organic solvent wash, the paper comprises a web of cellulosic fibers, said web containing a metal mordant first co-reactant, chemically isolated from a mordant dye second co-reactant capable of forming a coordinate covalent bond with the metal mordant first co-reactant to produce an organic solvent-insoluble colored reaction product which remains entrapped in the web when the paper is washed with an organic solvent. In one embodiment, one of said co-reactants is chemically isolated from the other on said web by encapsulation with a water-insoluble and organic solvent-soluble material.

The co-reactants alternatively may be chemically isolated from each other by providing a barrier layer between the co-reactants. Yet another technique which may be used for chemical isolation is disposing the co-reactants on opposite surfaces of the paper or a layer of the web, or by separating (offsetting) the co-reactants from each other along the plane of the web.

The present invention thus provides the art with an improved security paper which indicates exposure to an organic solvent via the production of a colored reaction product which color is organic solvent-wash resistant. The chemical isolation of the present invention prevents the color reaction product from forming until the paper is washed with an organic solvent. Thus, the application of pressure alone to the security paper does not cause the color reaction product to form.

DETAILED DESCRIPTION OF THE INVENTION

The present invention provides an improved security paper. A security paper may be employed for the production of handwritten payment vouchers, for official documents such as bank checks, for travelers' checks, and for identity documents such as passports, and the like. The security paper of this invention forms an indelible colored signal when it is exposed or treated with an organic solvent. The colored signal is formed upon the reaction between a metal mordant first co-reactant which is chemically isolated from a mordant dye second co-reactant capable of forming a coordinate covalent bond with the metal mordant first co-reactant. Specifically, the present invention provides the art with a security paper which generates a color signal indicative of the fact that the paper has been exposed to an organic solvent, the color is resistant to removal by organic solvents.

The security paper of the present invention provides an indication that it has been treated with an organic solvent by developing an easily-perceived color change. The thus-developed color signal is resistant to an organic solvent wash because of the formation of coordinate covalent bonds. Additionally, to ensure that the developed color cannot be removed from the paper, it is also necessary that one element of the dye product permanently react with and/or attach to cellulose fibers, permanently react with and/or attach to some constituent that is already bound to the cellulosic fiber substrate, or otherwise become trapped in the cellulosic fiber web constituting the paper.

One way to accomplish this attachment of the developed color signal to the cellulosic web is to use coordinate covalent bond formation between one component of a reactant pair that forms a colored dye, which is attached or fixed to the cellulosic fiber substrate and a second isolated component of the reactant pair.

The coordinate covalent bond is formed when the mordant dye has an atom with a pair of unshared electrons and donates one of these electrons to an acceptor species (metal mordant), which has a free electronic orbital. Unlike the formation of a covalent bond in which both atoms contribute one electron to forming the bond, in the present invention the donor atom contributes both of the electrons needed to form the bond. This type of bond can be readily formed at ambient conditions and can also be formed in a non-aqueous system. The bonds which are formed are quite strong and resistant to chemical (solvent) wash or attack.

A metal mordant is the first co-reactant of the present invention and acts as the acceptor species in the coordinate covalent bond formation of the present invention. The metal mordant can be a metal cation from a metal salt. Suitable metal salts include those that are divalent or trivalent based on the following metals, e.g., Fe, Mn, Sn, Ni, Ca, Al, Cu, Cd, Cr, Co, Pb, Hg, and Mg. Specific salts include ferric chloride, nickel cation, and copper cation. The metal mordant can be applied topically to the paper at the size press in a paper making process. At the size press, sizing agents are added to the paper to increase its strength and reduce its water absorbency. Applying the metal mordant at the size press permits it to form an attachment to the paper or to be fixed with the carboxyl-groups along the length of the cellulose fibers. The metal mordant also can be applied at the wet end of the paper making process, preferably along with a fixing agent or a retention aid, e.g., polyethyleneimine (PEI) or polyacrylamide. The fixing agent or the retention aid with positive charges conforms to the cellulose fiber surface carrying negative charges and can become permanently affixed. The metal mordant can form a coordinate covalent bridge between the fixing agent and the mordant dye.

The wet end of the paper machine making alkaline paper is usually maintained at a pH greater than 7.0, frequently between 7.5–8.0. At these elevated pH's, a large number of OH-groups exist along the cellulosic fiber in the paper and will compete with ligands on a mordant dye to form coordinate covalent bonds with the metal cation when the paper/cellulosic fiber is exposed to a mordant dye. An equilibrium state thus exists which favors the stronger ligand. The pH at which complexing between hydroxyl groups and a metal cation occurs is approximately the pKa of the cation. The pKa of a metal cation, in turn, is an approximate indication of its strength as a metal mordant. In a preferred embodiment, metal cations having a pKa higher than the pH of the whitewater used in the paper manufacturing process is employed. In particular, a metal cation having a pKa greater than 8 is generally preferred. In one mordant dye/metal mordant system a solution of a nickel or a copper salt is used, such as a solution of $Ni(NO_3)_2$.

The metal mordant dye first co-reactant also may be applied to many types of paper after production. For example, metal cations can be applied to paper from a water solution using a flexographic press.

A mordant dye is the second co-reactant of the present invention and can be applied to the paper using any printing or coating method. Suitable methods include flexo, rod, gravure, air knife, ink jet, offset, thermal transfer, xerography, magnetography, laser, etc. Such applications can be made before, during, or after normal check printing/decorating steps. The mordant dye or both the dye and the metal mordant co-reactants, also can be applied to the paper in a way that would form a recognizable image, e.g., a letter or other pattern, the word "VOID," etc., upon exposure to an organic solvent. Suitable mordant dyes include those compounds which form a color with a metal mordant and which possess a pair of unshared electrons such that the dye molecule can form a coordinate covalent bond with the metal mordant. Preferably the mordant dye is a non-ionic compound. More preferably, the mordant dye has a stereochemical structure leading to the formation of bidentate or multidentate coordinate covalent bonds. Suitable mordant dye compounds include alizarine blue, alizarine orange, alizarine yellow, aluminon, 1-aminoanthraquinone-2-carboxylic acid, o-aminobenzoic acid, 3-amino-2-naphthoic acid, 1-amino-2-naphthol-4-sulfonic acid, ampelopsin, anacardic acid, anthragallol, baicalein, 5-bromoanthranilic acid, 3'-carboxy-4'-hydroxycinchophen, carminic acid, catechin, o-cresotic acid, delphinidin chloride, 2,3-diaminophenazine, 2,4-diaminophenol, digallic acid, dimethylglyoxime, echinochrome, eriochrome® black T, eriodictyol, ethyl thiocyanate, ferrocyanidion, fisetin, flavone, fustin, gallacetophenone, gallamide, gallein, gallic acid, gentisic acid, α-glucogahin, β-glucogallin, gossypol, hematein, hematoxylin, 4-hydroxylisophthalic acid, 1-hydroxy-2-naphthoic acid, 3-hydroxy-2-naphthoic acid, 3-(2-hydroxy-1-naphthylmethyl)salicylic acid, 3-hydroxy-2-phenylcinchoninic acid, isoquercitrin, leucocyanidin, luteolin, maclurin, methylenedigallic acid, 5,5'-methylenedisalicylic acid, morin, munjistin, myricetin, dimethylglyoxime, 3-nitrosalicylic acid, 1-nitroso-2-naphthol, pamoic acid, potassium ferricyanide, potassium ferrocyanide, potassium thiocyanate, pyrocatechol, pyrogallol, pyroligneous acid, quercetagetin, quercetin, quercitrin, β-resorcylic acid, rhamnetin, rubeanic acid, rufigallol, rutin, salazosulfadimidine, salazosulfamide, salicil, salicylamide, salicylazosulfapyridine, salicylic acid, scutellarein, tannic acid, thiosalicylic acid, o-thymotic acid.

In one preferred embodiment, dithiooxamide (Rubeanic acid) is used. The mordant dye normally is added to the paper in a form which does not appreciably color the paper during formation of the security paper product. This can be accomplished by a variety of means known in the art. In one embodiment, for example, a relatively small number of dye particles of a size in the range of about 0.3 to 50μ, preferably about 20μ are added to the paper, so that they do not create an appreciable visual effect. Preferably, the paper used to prepare the security paper product has a color different from the color that is formed upon the reaction of the metal mordant and the mordant dye for the purpose of easy recognition of the color signal upon exposure to an organic solvent.

In another embodiment, a substantially colorless metal mordant and mordant dye can be used which upon co-reaction produce an intense, indelible color in the security paper. The reaction occurs as the metal cation of the metal mordant forms bidentate coordinate covalent bonds with ligands on the benzene ring of the mordant dye. Certainly any mordant dye with virtually any benzenoid ring having ortho ligand groups such as OH, COO—, CN, SH, SCN—, etc. can be used. One example of this embodiment is the combination ferric chloride (metal mordant) and tannic acid (mordant dye). When the metal mordant and the mordant dye come together, an insoluble precipitate forms having an intense black-violet color. By virtue of its molecular weight and size, the precipitate can not be removed from the paper by an organic solvent wash and thus becomes fixed or trapped in the paper.

According to the present invention, the metal mordant and the mordant dye are chemically isolated from each other in the paper so that the color reaction by coordinate covalent bond formation does not occur until the paper is exposed to an organic solvent. Therefore, application of pressure alone to the paper, e.g., during normal handling of the paper or even during an attempted forgery, does not cause the color reaction product to form.

The chemical isolation may be effected by any one of several techniques, or combinations thereof. One technique which may be used is encapsulating either the metal mordant or the mordant dye co-reactant in a matrix that is water insoluble, but organic solvent soluble. Suitable materials that can be used for such encapsulation or coating composition are waxes, polymethlymethacrylate, carnauba wax, 8-hydroxyquinoline, and certain polyethylene glycols. These materials are readily available and can be applied to or mixed with the co-reactant compound by any means known in the art so that the compound is coated or otherwise encapsulated with the material. In a preferred embodiment, the melting point of the coating material should be higher than the melting point of the compound to be encapsulated, such that the coating can be applied using a molten coating composition. Usually, the encapsulation is carried out at a temperature of about 20–65° C. In one embodiment, a combination of mordant dyes can be mixed to produce a lower melting point composition, e.g., a composition having a melting point lower than 50° C. and be melted together to make a sealed capsule. The coating should be water-insoluble, impermeable to the dye, and dissipate upon exposure to an organic solvent wash. This coating should also be sufficiently stable to resist degradation at temperatures encountered during the paper-making process. In one embodiment, the coating also should be temperature stable to brief exposure at a temperature of up to 400° F. in anticipation of the paper being employed in a laser printing process. Encapsulation of the mordant dye or metal mordant prevents the premature mixing of the co-reactants and ensures that the development of color does not occur until exposure of the security paper to an organic solvent, especially acetone, which is the solvent most often used for altering security paper, e.g., checks. Other commonly used solvents include, non-acetone Cutex®, dimethyl sulfoxide (DMSO), N-methyl pyrrolidone (NMP), Dowanol® EPH (ethylene glycolphenyl ether), and glycol ether EB.

Another technique effective for chemical isolation is disposing the co-reactants on opposite surfaces of the paper or a layer of the web, or by separating (offsetting) the co-reactants from each other along the plane of the paper web. The co-reactants alternatively can be chemically isolated by providing a barrier layer between the co-reactants. Any suitable rganic soluble material may be used to form the barrier layer, e.g., poly(vinyl alcohol), methylcellulose, hydroxyethylcellulose, styrene-butadiene latex, styrene-maleic anhydride copolymer, melamine-formaldehyde resin, and the like.

By physically separating the co-reactants, the need for encapsulation is avoided. In addition, crystalline particles which do not encapsulate well can be used. For example, 1,2-dihydroxy anthraquinone (Alizarin) has a needle-like structure that may protrude through the wall of the capsule. The portion of the material exposed to water can dissolve, and may cause the paper to prematurely darken. Therefore, 1,2-dihydroxy anthraquinone has been found to be a troublesome dye for the encapsulation approach to chemical isolation.

One preferred combination for this embodiment of the invention is 1,2-dihydroxy anthraquinone (Alizarin) with nickel ($Ni^{+2}$) cations. As described above, it is preferred to use paper manufactured with a fixing agent or a retention aid, e.g., polyethyleneimine (PEI) or polyacrylamide. The fixing agent or the retention aid with positive charges conforms to the cellulose fiber surface carrying negative charges and can become permanently affixed. The metal mordant can form a coordinate covalent bridge between the fixing agent and the mordant dye. Other dyes which may be used in this embodiment include di-azo dyes that have ligands ortho to the azo bond that coordinate with nickel cations. Non-limiting examples include dithiooxamide, dimethylglyoxime, Acid Black 63 (C.I. 12195), N,N' dimethyl dithiooxamide, N,N' diethyl dithiooxamide, C.I. Pigment Blue 16 (C.I. 74100), Alizarin Cyanine G (C.I. 63020), C.I. Mordant Brown 6 (C.I. 11875), C.I. Mordant Brown 66 (C.I. 11890), Zapon Fast Black NC (C.I. 12050), C.I. 11970, and C.I. Acid Black 19 (C.I. 12200).

EXAMPLES

The following examples are provided for exemplification purposes only and are not intended to limit the scope of the invention.

Example 1

This experiment shows that Rubeanic acid can react with $Ni^{+2}$ in a paper to form an indelible color.

Handsheets were made to test the color forming reaction between rubeanic acid and $Ni^{+2}$. In a handsheet mold, 9.0 g of cellulose pulp, 1 ml of a 10% stock solution of PEI, and 5 ml of $H_2SO_4$ were added to form a slurry mixture. The pH of the mixture was about 7.5. Shortly after the addition of PEI, 0.09 g of $Ni(NO_3)_2$ was also added to the aqueous mixture. Handsheets were made according to the conventional method. Several drops of a rubeanic acid-acetone solution were thereafter applied to the handsheet paper. A characteristic blue color was observed which indicates a reaction between $Ni^{+2}$ and rubeanic acid. The sheet turned blue slowly when only rubeanic acid-acetone was applied. The color developed immediately when a drop of water was applied to the same area after application of the rubeanic-acetone solution. The water probably had the effect of increasing the solubility of the $Ni^{+2}$ salt so that the coordination reaction with the rubeanic acid could occur more quickly.

Example 2

The following experiment can be used to show that 1,2-dihydroxy anthraquinone can react with $Ni^{+2}$ in a paper to form an indelible color.

The word "VOID" can be printed on the face of the check and 1,2-dihydroxy anthraquinone can be applied to the opposite side of the check. The 1,2-dihydroxy anthraquinone can be applied by mixing it into the ink used to print the opposite side of the check. Alternatively, the word "VOID" can be printed in the dollar box of the check and the ink used to print the front of the check can contain 1,2-dihydroxy anthraquinone (Alizarin). In either case, the means of preventing the premature reaction of the reactants would be the physical separation of the reactants by the paper itself.

When the paper is washed with an organic solvent such as acetone, the word "VOID" will appear in a dark blue-violet color via reaction between the 1,2-dihydroxy anthraquinone and the $Ni^{+2}$ cations as the solvent wash brings the reactants together.

The principles, preferred embodiments and modes of operation of the present invention have been described in the foregoing specification. The invention which is intended to be protected herein, however, is not to be construed as limited to the particular forms disclosed, since they are to be regarded as illustrative rather than restrictive. Variations and changes may be made by those skilled in the art without departing from the spirit of the invention.

What is claimed is:

1. A security paper which forms an indelible color when contacted with an organic solvent comprising a web of cellulosic fibers, said web containing a metal mordant dye first co-reactant in particulate form chemically isolated from a mordant dye second co-reactant in particulate form, said mordant dye second co-reactant forming a coordinate covalent bond with said metal mordant dye first co-reactant to produce an organic solvent-insoluble colored reaction product when the paper is washed with an organic solvent, said chemical isolation preventing said coordinate covalent bond from forming until the paper is washed with an organic solvent and said organic solvent insoluble colored reaction product remaining entrapped in the web when the paper is washed with an organic solvent, wherein said organic solvent-insoluble colored reaction product does not form upon the application of pressure alone to said paper.

2. The security paper of claim 1 wherein said chemical isolation comprises disposing said metal mordant dye first co-reactant and said mordant dye second co-reactant on opposite sides of a layer of said web.

3. The security paper of claim 1 wherein said chemical isolation comprises providing a barrier layer between said metal mordant dye first co-reactant and said mordant dye second co-reactant.

4. The process of claim 1 wherein said chemical isolation comprises disposing said metal mordant dye first co-reactant and said mordant dye second co-reactant on said web such that said co-reactants are spaced from one another along a plane of said web.

5. The security paper of claim 1 wherein the metal mordant has a pKa greater than 8.

6. The security paper of claim 1 wherein the metal mordant is selected from the group consisting of Fe, Mn, Sn, Ni, Ca, Al, Cu, Cd, Cr, Co, Pb, Hg, and Mg.

7. The security paper of claim 1 wherein the mordant dye second co-reactant is selected from the group consisting of alizarine blue, alizarine orange, alizarine yellow, aluminon, 1-aminoanthraquinone-2-carboxylic acid, o-aminobenzoic acid, 3-amino-2-napththoic acid, 1-amino-2naphthol-4-sulfonic acid, ampelopsin, anacardic acid, anthragallol, biacalein, 5-bromoanthranilic acid, 3'-carboxy-4'-hydroxycinchophen, carminic acid, catechin, o-cresotic acid, delphinidin chloride, 2,3-diaminophenazine, 2,4-diaminophenol, digallic acid, dimethylglyoxime, echinochrome, eriochrome® black T, eriodictyol, ethyl thiocyanate, ferrocyanidion, fisetin, flavone, fustin, gallacetophenone, gallamide, gallein, gallic acid, gentisic acid, α-glucogallin, β-glucogallin, gossypol, hematein, hematoxylin, 4-hydroxylisophthalic acid, 1-hydroxy-2-naphthoic acid, 3-hydroxy-2-naphthoic acid, 3-(2-hydroxy-1-naphthylmethyl) salicylic acid, 3-hydroxy-2-phenylcinchoninic acid, isoquercitrin, leucocyanidin, luteolin, maclurin, methylenedigallic acid, 5,5'-methylenedisalicylic acid, morin, munjistin, myricetin, dimethylglyoxime, 3-nitrosalicylic acid, 1-nitroso-2-naphthol, pamoic acid, potassium ferricyanide, potassium ferrocyanide, potassium thiocyanate, pyrocatechol, pyrogallol, pyroligneous acid, quercetagetin, quercetin, quercitrin, β-resorcylic acid, rhamnetin, rubeanic acid, rufigallol, rutin, salazosulfadimidine, salazosulfamide, salicil, salicylamide, salicylazosulfapyridine, salicylic acid, scutellarein, tannic acid, thiosalicylic acid, and o-thymotic acid.

8. The security paper of claim 1 wherein the mordant dye second co-reactant is of a size from about 0.3μ to 50μ.

9. The security paper of claim 1 wherein the metal mordant dye is ferric chloride and the mordant dye is tannic acid.

10. The security paper of claim 1 wherein the metal mordant dye is a nickel cation and the mordant dye is dithiooxamide.

11. The security paper of claim 1 wherein the metal mordant dye is a copper cation and the mordant dye is dithiooxamide.

12. A method of making the security paper of claim 1 comprising the steps of:

(a) contacting a cellulose fiber paper substrate with a metal mordant first co-reactant in particulate form and (b) contacting the cellulose fiber paper substrate with a mordant dye second co-reactant in particulate form, said mordant dye second co-reactant forming a coordinate covalent bond with the metal mordant first co-reactant to produce an organic solvent insoluble colored reaction product when the paper is washed with an organic solvent, wherein the color reaction product remains entrapped in the web cellulosic fiber paper substrate when said paper substrate is washed with an organic solvent, and wherein said organic solvent-insoluble colored reaction product does not form upon the application of pressure alone to said paper.

13. A security paper which forms an indelible color when contacted with an organic solvent comprising a web of cellulosic fibers, said web containing a metal mordant first co-reactant in particulate form chemically isolated from a mordant dye second co-reactant in particulate form, wherein one of said metal mordant first co-reactant and said mordant dye second co-reactant is attached to said cellulosic fibers, wherein said mordant dye second co-reactant forms a coordinate covalent bond with the metal mordant first co-reactant to produce an organic solvent-insoluble colored reaction product when the paper is washed with an organic solvent, said chemical isolation preventing said coordinate covalent bond from forming until the paper is washed with an organic solvent, wherein said organic solvent-insoluble colored reaction product remains entrapped in the web when the paper is washed with an organic solvent, and wherein said organic solvent-insoluble colored reaction product does not form upon the application of pressure alone to said paper.

14. The security paper of claim 13 wherein said metal mordant first co-reactant is attached to the cellulosic fibers using a retention aid.

15. The security paper of claim 14 wherein the retention aid is selected from polyethyleneimine and polyacrylamide.

16. The security paper of claim 2 wherein the mordant dye second co-reactant is selected from the group consisting of 1,2-dihydroxy anthraquinone, dithiooxamide, dimethylglyoxime, and N,N' dimethyl dithiooxamide.

17. The security paper of claim 3 wherein the mordant dye second co-reactant is selected from the group consisting of 1,2-dihydroxy anthraquinone, dithiooxamide, dimethylglyoxime and, Acid Black N,N' dimethyl dithiooxamide.

18. The security paper of claim 4 wherein the mordant dye second co-reactant is selected from the group consisting of 1,2-dihydroxy anthraquinone, dithiooxamide, dimethylglyoxime and, Acid Black N,N' dimethyl dithiooxamide.

19. The security paper of claim 2 wherein the mordant is a nickel cation and the mordant dye is 1,2-dihydroxy anthraquinone.

* * * * *

UNITED STATES PATENT AND TRADEMARK OFFICE

CERTIFICATE OF CORRECTION

PATENT NO. : 6,159,585

DATED : December 12, 2000

INVENTOR(S) : David A. Rittenhouse

It is certified that error appears in the above-identified patent and that said Letters Patent is hereby corrected as shown below:

In Claim 17, column 10, line 14:

"and," has been replaced with --, and--.

"Acid Black" has been deleted.

In Claim 18, column 10, line 18:

"and," has been replaced with --, and--.

"Acid Black" has been deleted.

Signed and Sealed this

First Day of May, 2001

*Attest:*

Nicholas P. Godici

NICHOLAS P. GODICI

*Attesting Officer*

*Acting Director of the United States Patent and Trademark Office*